US011699402B2

(12) United States Patent
Koo et al.

(10) Patent No.: US 11,699,402 B2
(45) Date of Patent: Jul. 11, 2023

(54) DISPLAY DEVICE AND DATA DRIVING CIRCUIT

(71) Applicant: LG DISPLAY CO., LTD., Seoul (KR)

(72) Inventors: Hogeun Koo, Paju-si (KR); Hong Soon Kim, Paju-si (KR); Chan Park, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/974,283

(22) Filed: Oct. 26, 2022

(65) Prior Publication Data

US 2023/0144298 A1 May 11, 2023

(30) Foreign Application Priority Data

Nov. 10, 2021 (KR) ..... 10-2021-0153623

(51) Int. Cl.
*G09G 3/3291* (2016.01)

(52) U.S. Cl.
CPC ... *G09G 3/3291* (2013.01); *G09G 2310/0297* (2013.01); *G09G 2310/061* (2013.01); *G09G 2320/0233* (2013.01)

(58) Field of Classification Search
CPC ... G09G 2320/0233; G09G 2320/0238; G09G 2320/0266; G09G 2340/0435; G09G 2310/061; G09G 2310/0205; G09G 2310/066; G09G 3/3233
See application file for complete search history.

(56) References Cited

U.S. PATENT DOCUMENTS

2020/0160794 A1* 5/2020 Park ..... G09G 3/3291

* cited by examiner

*Primary Examiner* — Dong Hui Liang
(74) *Attorney, Agent, or Firm* — Morgan, Lewis & Bockius LLP

(57) ABSTRACT

Embodiments of the disclosure relate to a display device and a data driving circuit. The display device comprises a display panel including a plurality of subpixels and a plurality of data lines electrically connected with the plurality of subpixels and a data driving circuit outputting a data voltage to the plurality of data lines, wherein the data driving circuit outputs the data voltage for image display to the plurality of data lines during an active period and outputs a step voltage to stepwise decrease a level of the data voltage to a preset target voltage level or stepwise increase the level of the data voltage from the target voltage level during a blank period different from the active period. Specifically, there may be provided a display device and a data driving circuit capable of enhancing display quality in a dark mura area and a bright mura area by outputting a step voltage to stepwise decrease the level of a data voltage to a preset target voltage level or stepwise increase the level of the data voltage from the target voltage level during a blank period.

26 Claims, 11 Drawing Sheets

<Sampling Period>

<Ioled = Low period>

<Ioled = High period>

<Anode Reset Frame>

DISPLAY DEVICE AND DATA DRIVING CIRCUIT

CROSS-REFERENCE TO RELATED APPLICATION

This application claims priority from Korean Patent Application No. 10-2021-0153623, filed on Nov. 10, 2021, which is hereby incorporated by reference for all purposes as if fully set forth herein.

BACKGROUND

Technical Field

Embodiments of the disclosure relate to a display device and a data driving circuit.

Description of the Related Art

As the information society develops, various demands for display devices for displaying images are increasing, and various types of display devices, such as liquid crystal displays (LCDs) and organic light emitting diode (OLED) displays, are used.

Among these display devices, the organic light emitting displays adopt organic light emitting diodes (OLEDs) and thus has fast responsiveness and various merits in contrast ratio, luminous efficiency, brightness, and viewing angle.

The organic light emitting display device may include organic light emitting diodes (OLEDs) each disposed in each of a plurality of subpixels disposed on the display panel and allows the organic light emitting diodes (OLEDs) to emit light by controlling the current flowing through the organic light emitting diodes (OLEDs), thereby displaying an image while controlling the brightness of each subpixel.

The image data supplied to the display device may be a still image or a video that is variable at a constant speed, such as a sports video, movie, or game video.

A plurality of signal lines may be disposed on the display panel to drive such a display device.

As the structure of the subpixel becomes more complicated, an unintended parasitic capacitance may be formed between the signal line and various electrodes of the subpixel. The display quality may be degraded due to unintentional parasitic capacitance.

BRIEF SUMMARY

Embodiments of the disclosure may provide a display device and a data driving circuit, capable of enhancing display quality in a dark mura area and a bright mura area.

According to embodiments of the disclosure, there may be provided a display device comprising a display panel including a plurality of subpixels and a plurality of data lines electrically connected with the plurality of subpixels and a data driving circuit outputting a data voltage to the plurality of data lines, wherein the data driving circuit outputs the data voltage for image display to the plurality of data lines during an active period and outputs a step voltage to stepwise decrease a level of the data voltage to a preset target voltage level or stepwise increase the level of the data voltage from the target voltage level during a blank period different from the active period.

According to embodiments of the disclosure, there may be provided a data driving circuit comprising an image display voltage output circuit outputting a data voltage for image display during an active period and a voltage stabilization circuit outputting the data voltage of a preset target voltage level, wherein the data driving circuit outputs a step voltage to stepwise decrease a level of the data voltage to the target voltage level or stepwise increase the level of the data voltage from the target voltage level during a blank period other than the active period.

According to embodiments, there may be provided a display device and a data driving circuit, capable of enhancing display quality in a dark mura area and a bright mura area.

According to embodiments, there may be provided a display device and a data driving circuit capable of enhancing display quality in a dark mura area and a bright mura area by outputting a step voltage to stepwise decrease the level of a data voltage to a preset target voltage level or stepwise increase the level of the data voltage from the target voltage level during a blank period.

DESCRIPTION OF DRAWINGS

The above and other objects, features, and advantages of the disclosure will be more clearly understood from the following detailed description, taken in conjunction with the accompanying drawings, in which.

DETAILED DESCRIPTION

Hereinafter, embodiments of the disclosure are described in detail with reference to the accompanying drawings. The same or substantially the same reference denotations are used to refer to the same or substantially the same elements throughout the specification and the drawings. When determined to make the subject matter of the disclosure unclear, the detailed description of the known art or functions may be skipped. The terms "comprises" and/or "comprising," "has" and/or "having," or "includes" and/or "including" when used in this specification specify the presence of stated features, regions, integers, steps, operations, elements, and/ or components, but do not preclude the presence or addition of one or more other features, regions, integers, steps, operations, elements, components, and/or groups thereof. As used herein, the singular forms "a", "an" and "the" are intended to include the plural forms as well, unless the context clearly indicates otherwise.

Such denotations as "first," "second," "A," "B," "(a)," and "(b)," may be used in describing the components of the disclosure. These denotations are provided merely to distinguish a component from another, and the essence of the components is not limited by the denotations in light of order or sequence.

In describing the positional relationship between components, when two or more components are described as "connected", "coupled" or "linked", the two or more components may be directly "connected", "coupled" or "linked"", or another component may intervene. Here, the other component may be included in one or more of the two or more components that are "connected", "coupled" or "linked" to each other.

In relation to components, operational methods or manufacturing methods, when A is referred to as being "after," "subsequent to," "next," and "before," B, A and B may be discontinuous from each other unless mentioned with the term "immediately" or "directly."

When a component is designated with a value or its corresponding information (e.g., level), the value or the corresponding information may be interpreted as including a tolerance that may arise due to various factors (e.g., process factors, internal or external impacts, or noise).

Hereinafter, various embodiments of the disclosure are described in detail with reference to the accompanying drawings.

Figure 1:
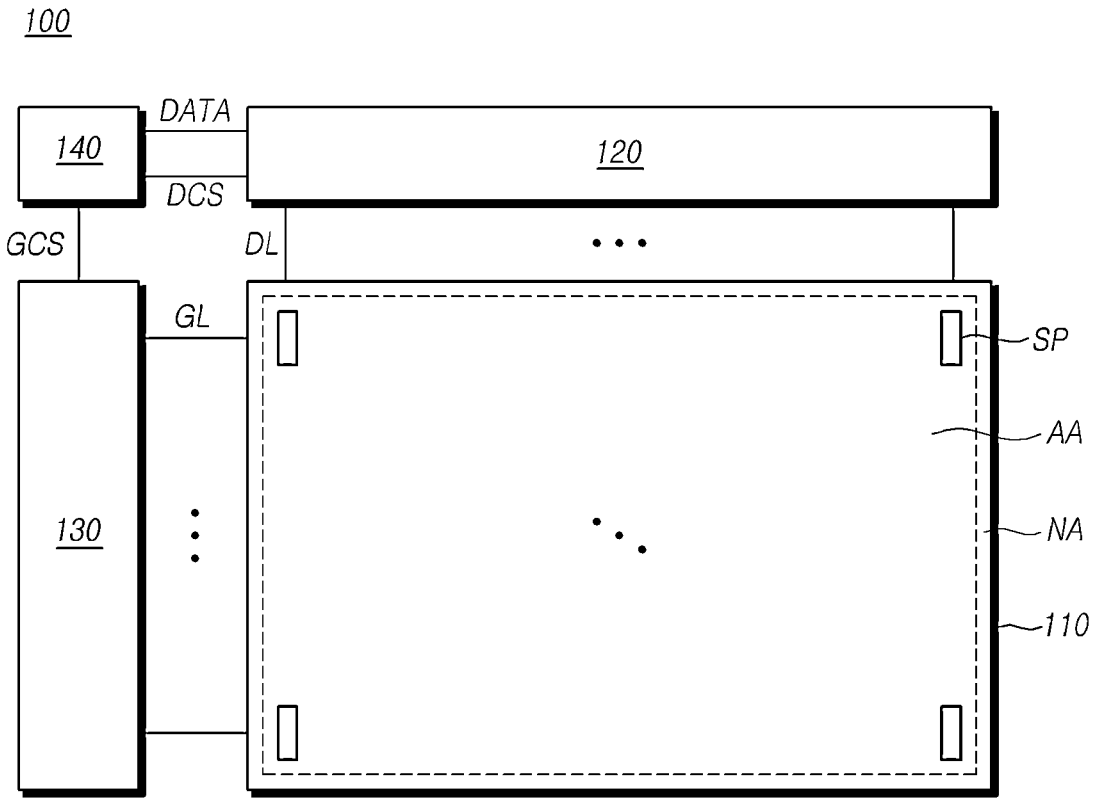
FIG. 1 is a view schematically illustrating a display device according to embodiments of the disclosure.

FIG. 1 is a view schematically illustrating a display device 100 according to embodiments of the disclosure.

Referring to FIG. 1, a display device 100 according to the disclosure may include a display panel 110, a data driving circuit 120 and a gate driving circuit 130 for driving the display panel 110, and a controller 140 configured to control the data driving circuit 120 and the gate driving circuit 130.

In the display panel 110, signal lines, such as a plurality of data lines DL and a plurality of gate lines GL, may be disposed on a substrate. In the display panel 110, a plurality of subpixels SP electrically connected with the plurality of data lines DL and the gate lines GL may be disposed.

The display panel 110 may include a display area AA in which images are displayed and a non-display area NA in which no image is displayed. In the display panel 110, a plurality of subpixels SP for displaying an image may be disposed in the display area AA and, in the non-display area NA, the data driving circuit 120 and the gate driving circuit 130 may be mounted, or pad units connected with the data driving circuit 120 or the gate driving circuit 130 may be disposed.

The data driving circuit 120 is a circuit configured to drive the plurality of data lines DL, and may supply data voltages to the plurality of data lines DL. The gate driving circuit 130 is a circuit configured to drive the plurality of gate lines GL, and may supply gate signals to the plurality of gate lines GL. The controller 140 may supply a data driving timing control signal DCS to the data driving circuit 120 to control the operation timing of the data driving circuit 120. The controller 140 may supply a gate driving timing control signal GCS for controlling the operation timing of the gate driving circuit 130 to the gate driving circuit 130.

The controller 140 may start scanning according to a timing implemented in each frame, convert input image data input from the outside into image data DATA suited for the data signal format used in the data driving circuit 120, supply the image data DATA to the data driving circuit 120, and control data driving at an appropriate time suited for scanning.

The controller 140 receives, from the outside (e.g., a host system), various timing signals including a vertical synchronization signal Vsync, a horizontal synchronization signal Hsync, an input data enable signal DE, and a clock signal, along with the input image data.

To control the data driving circuit 120 and the gate driving circuit 130, the controller 140 receives timing signals, such as the vertical synchronization signal Vsync, horizontal synchronization signal Hsync, input data enable signal DE, and clock signal CLK, generates various control signals DCS and GCS, and outputs the control signals to the data driving circuit 120 and the gate driving circuit 130.

To control the gate driving circuit 130, the controller 140 outputs various gate driving timing control signals GCS including a gate start pulse GSP, a gate shift clock GSC, and a gate output enable signal GOE.

To control the data driving circuit 120, the controller 140 outputs various data driving timing control signals DCS including, e.g., a source start pulse SSP and a source sampling clock SSC.

The data driving circuit 120 receives the image data DATA from the controller 140 and drives the plurality of data lines DL.

The data driving circuit 120 may include one or more source driver integrated circuit SDIC.

Each source driver integrated circuit SDIC may be connected with the display panel 110 by a tape automated bonding (TAB) method or connected to a bonding pad of the display panel 110 by a chip on glass (COG) method or may be implemented by a chip on film (COF) method and connected with the display panel 110.

The gate driving circuit 130 may output a gate signal of a turn-on level voltage or a gate signal of a turn-off level voltage according to the control of the controller 140. The gate driving circuit 130 may drive the plurality of gate lines GL by supplying gate signals of the turn-on level voltage to the plurality of gate lines GL.

The gate driving circuit 130 may be connected with the display panel 110 by a tape automated bonding (TAB) method or connected to a bonding pad of the self-emission display panel 110 by a COG or chip on panel (COP) method or may be connected with the display panel 110 according to a COF method.

The gate driving circuit 130 may be formed in a gate in panel (GIP) type, in the non-display area NA of the display panel 110. The gate driving circuit 130 may be disposed on the substrate of the display panel 110 or may be connected to the substrate of the display panel 110. The gate driving circuit 130 that is of a GIP type may be disposed in the non-display area NA of the substrate. The gate driving circuit 130 that is of a chip-on-glass (COG) type or chip-on-film (COF) type may be connected to the substrate of the display panel 110.

When a specific gate line GL is opened by the gate driving circuit 130, the data driving circuit 120 may convert the image data DATA received from the controller 140 into an analog data voltage and supply it to the plurality of data lines DL.

The data driving circuit 120 may be connected with one side (e.g., an upper or lower side) of the display panel 110. Depending on the driving scheme or the panel design scheme, the data driving circuit 120 may be connected with both sides (e.g., upper and lower sides) of the self-emission display panel 110, or two or more of the four sides of the self-emission display panel 110.

The gate driving circuit 130 may be connected with one side (e.g., a left or right side) of the display panel 110. Depending on the driving scheme or the panel design scheme, the gate driving circuit 130 may be connected with both sides (e.g., left and right sides) of the display panel 110, or two or more of the four sides of the display panel 110.

The controller 140 may be a timing controller used in typical display technology, a control device that may perform other control functions as well as the functions of the timing controller, or a control device other than the timing controller, or may be a circuit in the control device. The controller 140 may be implemented as various circuits or electronic components, such as an integrated circuit (IC), a field programmable gate array (FPGA), an application specific integrated circuit (ASIC), or a processor.

The controller 140 may be mounted on a printed circuit board or a flexible printed circuit and may be electrically connected with the data driving circuit 120 and the gate driving circuit 130 through the printed circuit board or the flexible printed circuit.

The controller 140 may transmit/receive signals to/from the data driving circuit 120 according to one or more predetermined interfaces. The interface may include, e.g., a low voltage differential signaling (LVDS) interface, an EPI interface, and a serial peripheral interface (SPI).

The controller 140 may include a storage medium, such as one or more registers.

The display device 100 according to embodiments of the disclosure may be a display including a backlight unit, such as a liquid crystal display, or may be a self-emission display, such as an organic light emitting diode (OLED) display, a quantum dot display, or a micro light emitting diode (LED) display.

When the display device 100 according to embodiments of the disclosure is an OLED display, each subpixel SP may include an organic light emitting diode (OLED), which is self-luminous, as a light emitting element. When the display device 100 according to embodiments of the disclosure is a quantum dot display, each subpixel SP may include a light emitting element formed of a quantum dot, which is a self-luminous semiconductor crystal. When the display device 100 according to embodiments of the disclosure is a micro LED display, each subpixel SP may include a micro light emitting diode, which is self-luminous and formed of an inorganic material, as a light emitting element. For convenience of description, an example in which the display device 100 according to embodiments of the disclosure is an OLED display is described below, but embodiments of the disclosure are not limited thereto.

Figure 2:
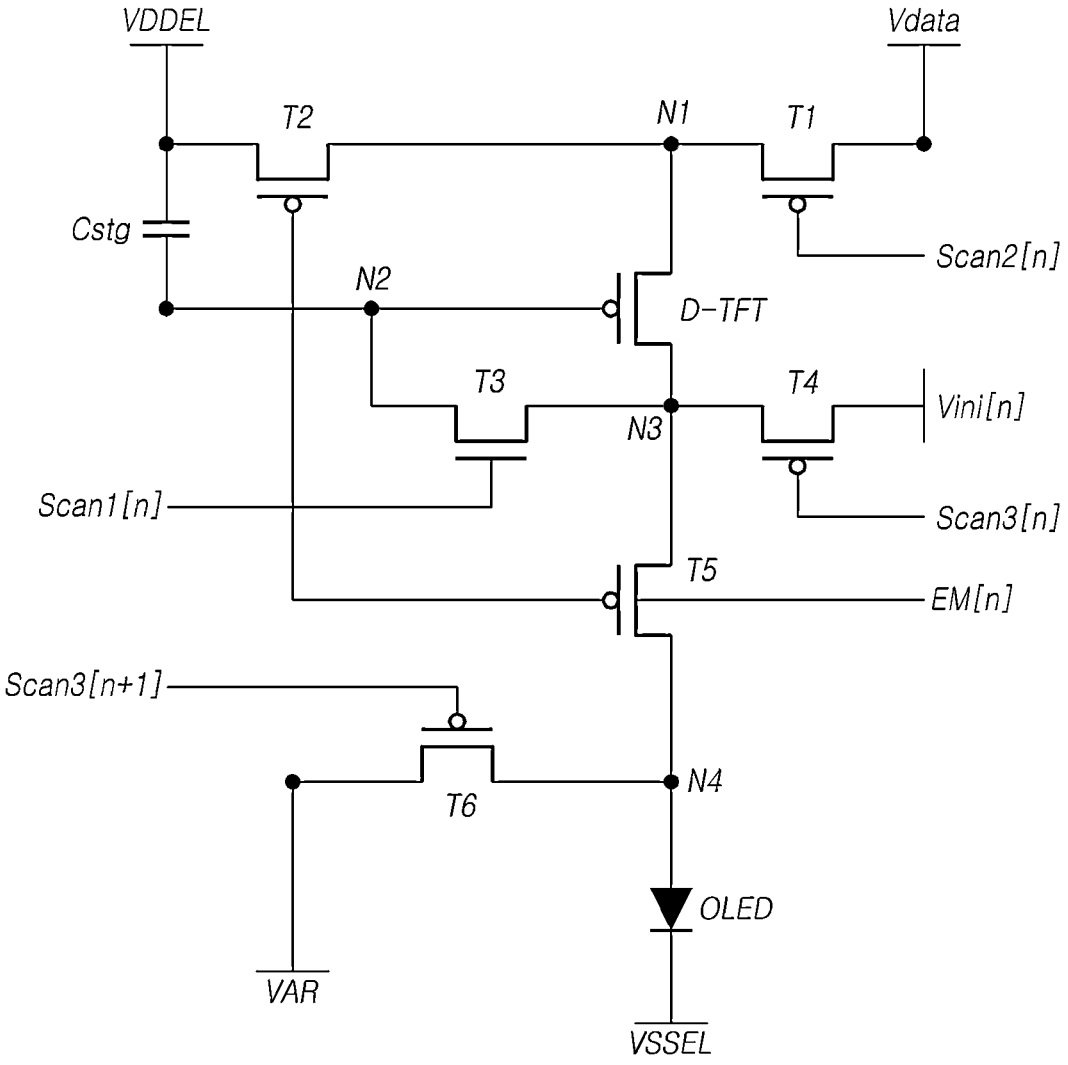
FIG. 2 is a view illustrating an example of a subpixel of a display device according to embodiments of the disclosure.

FIG. 2 is a view illustrating an example of a subpixel SP of a display device 100 according to embodiments of the disclosure.

Referring to FIG. 2, a subpixel SP may include an organic light emitting element OLED and a driving transistor D-TFT configured to drive the organic light emitting element OLED. The subpixel SP may further include one or more transistors in addition to the driving transistor D-TFT. Each subpixel SP may include one or more oxide semiconductor transistors (Oxide TFTs).

The subpixel SP may include the driving transistor D-TFT and first to sixth transistors T1 to T6. Each of the transistors may be a P-type transistor or an N-type transistor.

The N-type transistor may be formed of an oxide transistor formed of a semiconducting oxide (e.g., a transistor having a channel formed from a semiconducting oxide, such as indium, gallium, zinc oxide, or IGZO). The P-type transistor may be a silicon transistor formed of a semiconductor, such as silicon (e.g., a transistor having a polysilicon channel formed by a low-temperature process referred to as LTPS or low-temperature polysilicon).

The oxide transistor has relatively lower leakage current than the silicon transistor.

The subpixel SP may further include a storage capacitor Cstg configured to apply a voltage corresponding to the data voltage Vdata to the gate node of the driving transistor D-TFT during one frame period.

The structure of the subpixel SP including seven transistors and one capacitor is also referred to as a 7T1C structure.

For convenience of description, an example in which the subpixel SP in the display device 100 according to embodiments of the disclosure has a 7T1C structure is described below. However, the structure of the subpixel SP in the display device 100 according to embodiments of the disclosure is not limited to the 7T1C structure, and the subpixel SP may further include one or more circuit elements.

The first transistor T1 may be configured to switch an electrical connection between the first node N1 of the driving transistor D-TFT and the data line DL. The first node N1 of the driving transistor D-TFT may be any one of the source node and drain node of the driving transistor D-TFT. The operation timing of the first transistor T1 may be controlled by the second scan signal Scan2. If the second scan signal Scan2 of the turn-on level voltage is applied to the first transistor T1, the data voltage Vdata is applied to the first node N1 of the driving transistor D-TFT.

The second transistor T2 may be configured to switch an electrical connection between the first node N1 of the driving transistor D-TFT and the high-potential driving voltage VDDEL line. The operation timing of the second transistor T2 may be controlled by the light emission signal EM. If the light emission signal EM of the turn-on level voltage is applied to the second transistor T2, the high-potential driving voltage VDDEL is applied to the first node N1 of the driving transistor D-TFT.

The storage capacitor Cstg may include one end electrically connected to the second node N2 of the driving transistor D-TFT and the other end electrically connected to the high-potential driving voltage VDDEL line. The second node N2 of the driving transistor D-TFT may be the gate node of the driving transistor D-TFT.

The third transistor T3 is electrically connected between the second node N2 and the third node N3 of the driving transistor D-TFT. The operation timing of the third transistor T3 may be controlled by the first scan signal Scan1. The third node N3 of the driving transistor D-TFT may be the other one of the source node and the drain node of the driving transistor D-TFT.

The third transistor T3 may be an oxide transistor. Since the oxide transistor has a low leakage current, the voltage level of the second node N2 of the driving transistor D-TFT may remain constant. Accordingly, even when the data voltage Vdata for image display is not applied every frame, the subpixel SP may display an image on the screen based on the data voltage Vdata for image display input in the previous frame. This is referred to as low-frequency driving or low-speed driving.

The fourth transistor T4 may be configured to switch an electrical connection between the third node N3 of the driving transistor D-TFT and the initialization voltage Vini line. The fourth transistor T4 may be controlled by the third scan signal Scan3. If the third scan signal Scan3 of the turn-on level voltage is applied, the initialization voltage Vini is applied to the third node N3 of the driving transistor D-TFT.

The fifth transistor T5 may be configured to switch an electrical connection between the third node N3 of the driving transistor D-TFT and the first electrode of the organic light emitting element OLED. The fifth transistor T5 may include a fourth node N4 and is electrically connected to the first electrode of the organic light emitting element OLED through the fourth node N4 of the fifth transistor T5. The fourth node N4 of the fifth transistor T5 may be the source node or the drain node of the fifth transistor T5. The first electrode of the organic light emitting element OLED may be an anode electrode or a cathode electrode. In the following description, it is assumed that the first electrode of the organic light emitting element OLED is an anode electrode.

The operation timing of the fifth transistor T5 is controlled by the light emission signal EM. The light emission signal EM for controlling the operation timing of the fifth transistor T5 may be the same as the light emission signal EM for controlling the operation timing of the second transistor T2. The gate node of the fifth transistor T5 and the gate node of the second transistor T2 may be electrically connected to one light emission signal EM line.

The sixth transistor T6 may be configured to switch an electrical connection between the first electrode of the organic light emitting element OLED and the reset voltage VAR line. When the first electrode of the organic light emitting element OLED is an anode electrode, the reset voltage VAR may be an anode reset voltage VAR. If the reset voltage VAR is applied, the voltage of the first electrode of the organic light emitting element OLED is initialized to the reset voltage VAR. The voltage level of the reset voltage VAR may be the same as the voltage level of the low-potential driving voltage VSSEL applied to the second electrode (e.g., the cathode electrode) of the organic light emitting element OLED.

The operation timing of the sixth transistor T6 may be controlled by the third scan signal Scan3. The third scan signal Scan3 for controlling the operation timing of the sixth transistor T6 is the same as the third scan signal Scan3 for controlling the operation timing of the fourth transistor T4 of another subpixel SP.

For example, the third scan signal Scan3 may be applied to the sixth transistor T6 included in the subpixel SP electrically connected to the n+1th gate line (where n is an integer larger than or equal to 1). The third scan signal Scan3 applied to the subpixel SP may be the same signal as the third scan signal Scan3 applied to the fourth transistor T4 included in the subpixel SP positioned on the nth gate line.

The first electrode of the organic light emitting element OLED is electrically connected to the fourth node N4 of the fifth transistor T5. The second electrode of the organic light emitting element OLED is electrically connected to the low-potential driving voltage VSSEL line. The first electrode of the organic light emitting element OLED may be an anode electrode or a cathode electrode. The second electrode of the organic light emitting element GELD may be a cathode electrode or an anode electrode.

The high-potential driving voltage VDDEL line and the low-potential driving voltage VSSEL line may be common voltage lines commonly connected to the plurality of subpixels SP disposed on the display panel 110.

Referring to FIG. 2, the third transistor T3 may be an N-type transistor. The remaining transistors may be P-type transistors. The driving transistor D-TFT, the first transistor T1, the second transistor T2, the fourth transistor T4, the fifth transistor T5, and the sixth transistor T6 may be P-type transistors, or one or more of the above-described transistors may be formed of N-type transistors.

Figure 3:
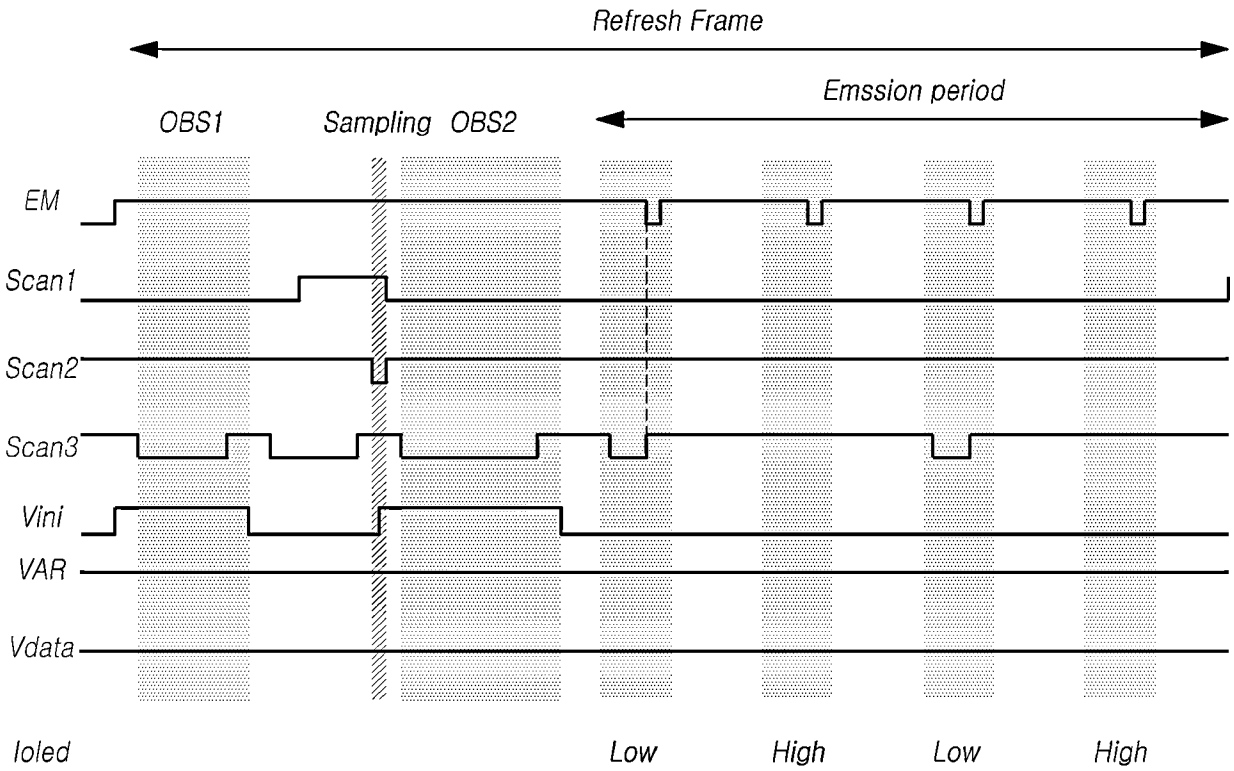
FIG. 3 is an example timing diagram of a refresh frame.

FIG. 3 is an example timing diagram of a refresh frame.

The driving period of the display device 100 according to embodiments of the disclosure may include a refresh frame and an anode reset frame.

A data voltage Vdata for image display may be applied to the plurality of data lines DL in the refresh frame.

During the sampling period Sampling, the data voltage Vdata for image display is applied to the subpixel SP. The voltage value corresponding to the corresponding data voltage Vdata is applied to one end of the above-described storage capacitor Cstg.

During the emission period, the second node N2 of the driving transistor D-TFT is electrically connected to one end of the storage capacitor Cstg, and a voltage value corresponding to the data voltage Vdata is applied thereto. If a light emission signal EM of a turn-on level voltage is applied during an emission period, the light emitting element emits light.

Hereinafter, the emission period is described based on the refresh frame. The emission period may also exist in the anode reset frame.

Figure 4:
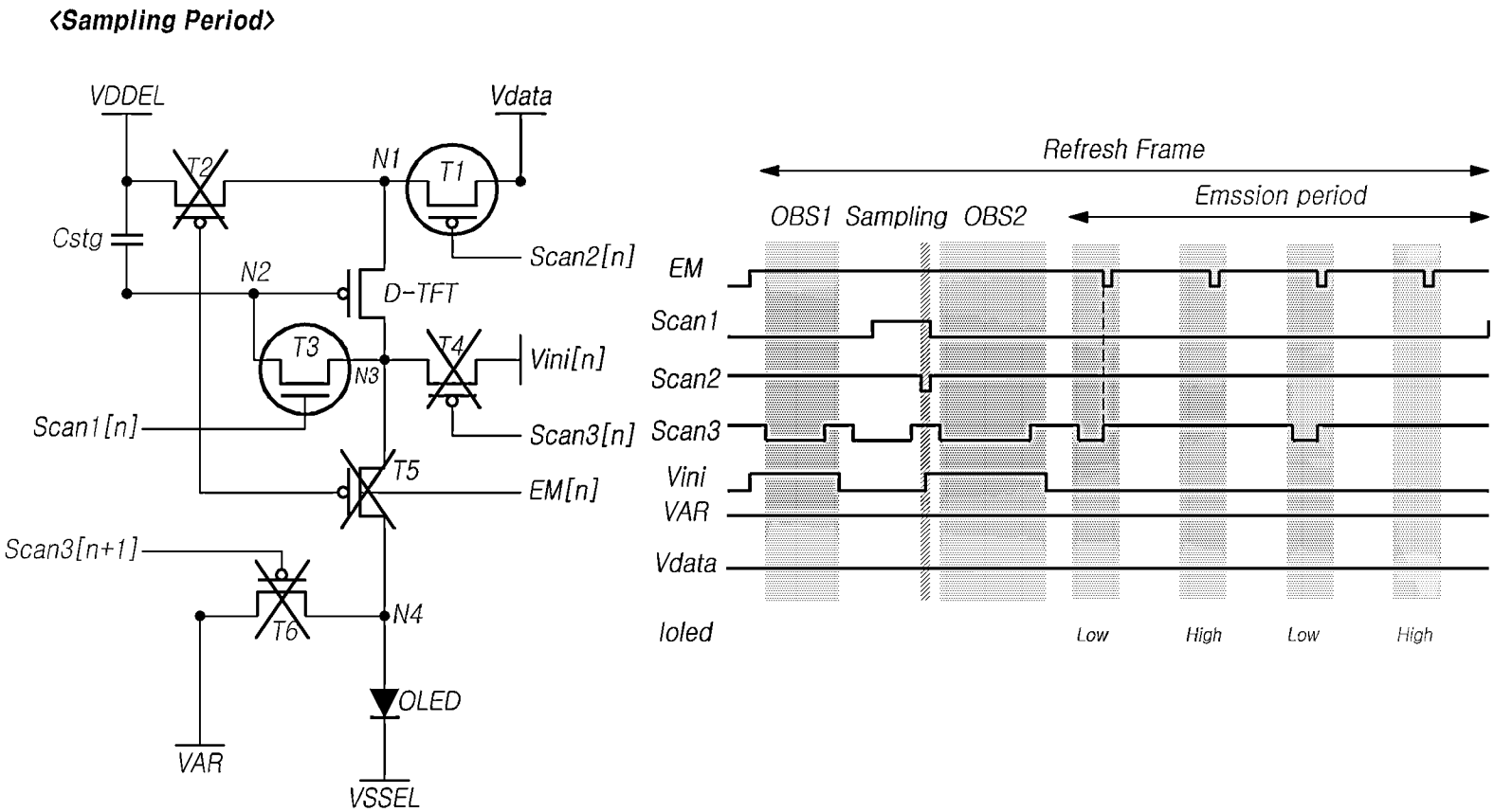
FIG. 4 is a view illustrating a sampling period in a display device according to embodiments of the disclosure.

FIG. 4 is a view illustrating a sampling period Sampling in a display device according to embodiments of the disclosure.

FIG. 4 is a timing diagram of a refresh frame period when a data voltage Vdata for image display is applied to the subpixel SP in the 7T1C structure.

The refresh frame may include a first on-bias period OBS1 and a second on-bias period OBS2 configured to apply the initialization voltage Vini_H of a high-level voltage to the third node N3 of the driving transistor DRT and a sampling period Sampling configured to apply a voltage corresponding to the data voltage Vdata to the second node N2 of the driving transistor D-TFT.

The on-bias periods OBS1 and OBS2 may be periods for alleviating a hysteresis effect that may occur in the driving transistor D-TFT and enhancing response characteristics.

During the sampling period Sampling, the light emission signal EM of a turn-off level voltage is applied to the second transistor T2 and the fifth transistor T5. A first scan signal Scan1 of a turn-on level voltage is applied to the third transistor T3. A second scan signal Scan2 of a turn-on level voltage is applied to the first transistor T1. A third scan signal Scan3 of a turn-off level voltage is applied to the fourth transistor T4 and the sixth transistor T6.

When the sampling period Sampling is entered, the initialization voltage Vini_L of the low-level voltage is applied to the third node N3 of the driving transistor D-TFT. If the third transistor T3 is turned on, the third node N3 and the second node N2 of the driving transistor D-TFT are electrically connected, a turn-on level voltage is applied to the second node N2 of the driving transistor D-TFT, and the driving transistor D-TFT is turned on.

If the driving transistor D-TFT, the first transistor T1, and the third transistor T3 are turned on during the sampling period Sampling, a voltage corresponding to the data voltage Vdata is applied to the second node N2 of the driving transistor D-TFT. Accordingly, a voltage corresponding to the data voltage Vdata is applied to one end of the storage capacitor Cstg.

Figure 5:
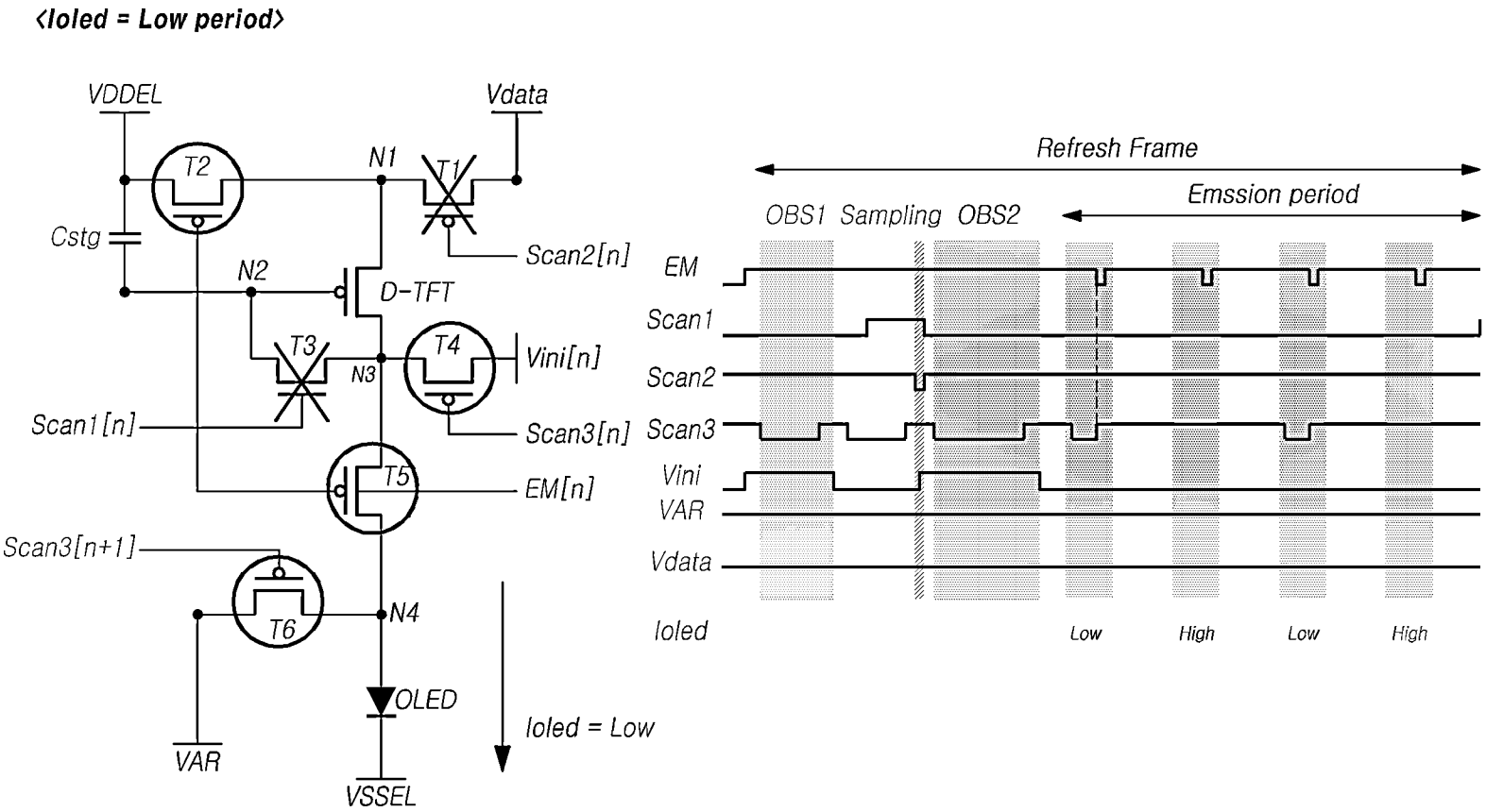
FIG. 5 is a view illustrating an emission period when a low current flows through a light emitting element in a display device according to embodiments of the disclosure.

FIG. 5 is a view illustrating a light emitting period when a low current flows through a light emitting element in a display device 100 according to embodiments of the disclosure.

The emission period may include a low period when the magnitude of current Ioled flowing through the light emitting element is relatively small and a high period when the magnitude of the current Ioled flowing through the light emitting element is relatively large.

When the current Ioled flowing through the light emitting element is relatively small, the light emitting element emits light with a relatively low brightness. When the current Ioled flowing through the light emitting element is relatively large, the light emitting element emits light with a relatively high brightness. The subpixel SP may be driven according to a desired grayscale value by adjusting the magnitude of the current flowing through the light emitting element.

FIG. 5 is a view illustrating a low period when the magnitude of the current Ioled flowing through the light emitting element is relatively small.

Referring to FIG. 5, the third scan signal Scan3 of the turn-on level voltage is applied to turn on the fourth transistor T4 and the sixth transistor T6.

The initialization voltage Vini is applied to the third node N3 of the driving transistor D-TFT. The initialization voltage Vini applied to the third node N3 of the driving transistor D-TFT is the initialization voltage Vini_L of the low-level voltage. The initialization voltage Vini_L of the low-level voltage is a voltage (e.g., −5V) of a level higher than the voltage level (e.g., −5.8V) of the low-potential driving voltage VSSEL.

A reset voltage VAR is applied to the first electrode of the organic light emitting element OLED. The level (e.g., −5.8V) of the reset voltage VAR may be the same as the voltage level (e.g., −5.8V) of the low-potential driving voltage VSSEL applied to the second electrode of the organic light emitting element OLED.

The first scan signal Scan1 and the second scan signal Scan2 are applied as turn-off level voltages. The first transistor T1 and the third transistor T3 are turned off. A voltage corresponding to the data voltage Vdata applied in the above-described sampling period Sampling is applied from the storage capacitor Cstg to the second node N2 of the driving transistor D-TFT.

The third scan signal Scan3 is applied as the turn-on level voltage and then the turn-off level voltage in the low period. The fourth transistor T4 and the sixth transistor T6 are turned off.

While the third scan signal Scan3 of the turn-off level voltage is applied, the light emission signal EM of the turn-on level voltage is applied. The fifth transistor T5 and the second transistor T2 are turned on.

If the light emission signal EM of the turn-on level voltage is applied, the high-potential driving voltage VDDEL is applied to the first node N1 of the driving transistor D-TFT. A voltage corresponding to the data voltage Vdata for image display is applied from the storage capacitor Cstg to the second node N2 of the driving transistor D-TFT.

If the voltage difference Vgs between the second node N2 and the third node N3 of the driving transistor D-TFT is larger than the threshold voltage Vth of the driving transistor D-TFT, the organic light emitting element OLED emits light.

The value of the current Ioled flowing through the light emitting element may vary according to a voltage difference between the voltages applied to two ends of the organic light emitting element OLED. The voltage level of the reset voltage VAR applied to the first electrode of the organic light emitting element OLED immediately before the light emission signal EM of the turn-on level voltage is applied is substantially equal to the voltage level of the low-potential driving voltage VSSEL applied to the second electrode of the organic light emitting element OLED.

Since the voltage level of the initialization voltage Vini_L of the low-level voltage applied to the third node N3 of the driving transistor D-TFT is higher than the voltage level of the reset voltage VAR, the voltage of the first electrode of the light emitting element gradually increases from the reset voltage VAR.

Accordingly, the current value of the current Ioled flowing through the light emitting element immediately after the voltage level of the third scan signal Scan3 is switched to the turn-off voltage level is relatively small.

Figure 6:
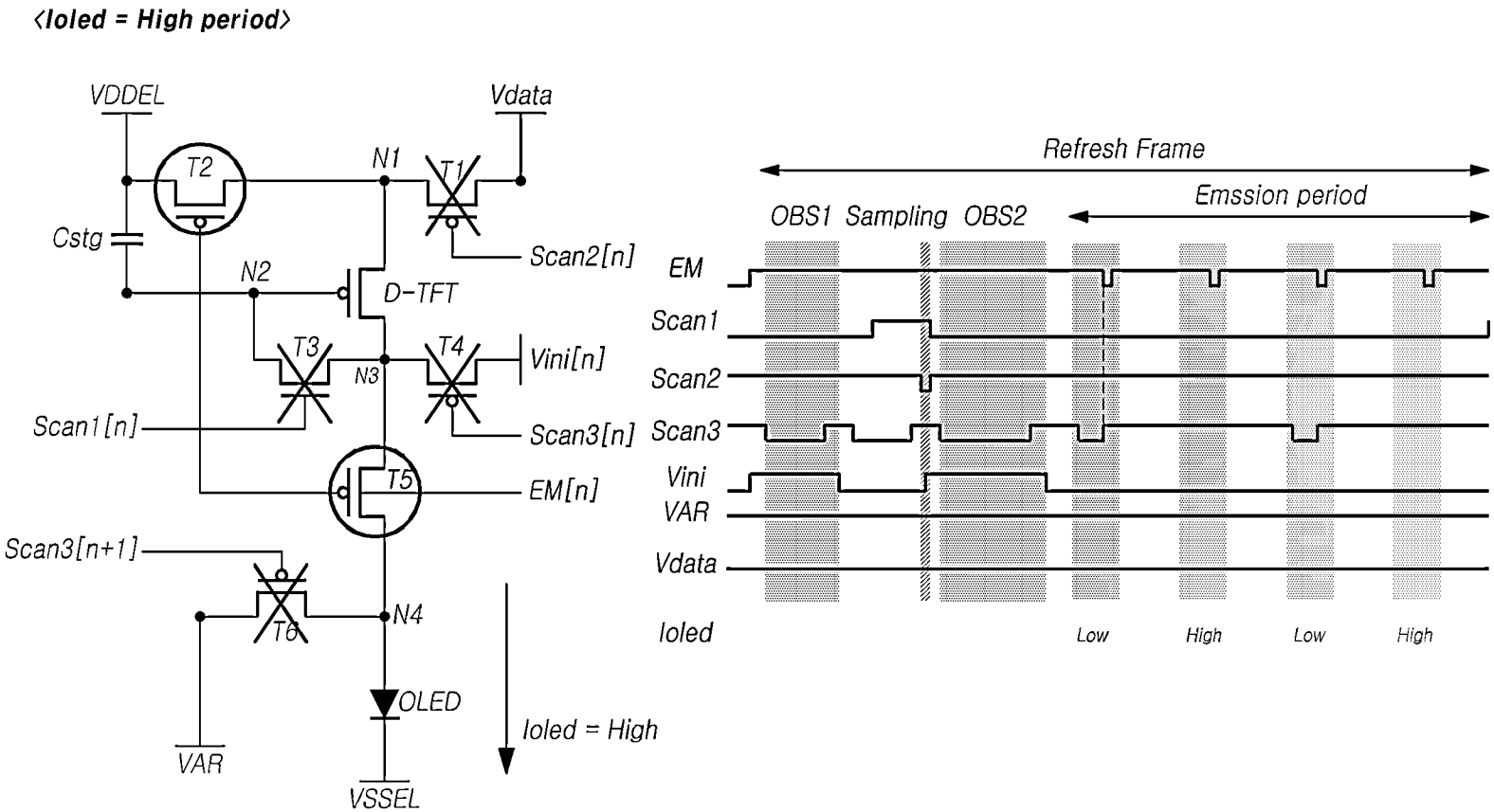
FIG. 6 is a view illustrating an emission period when a high current flows through a light emitting element in a display device according to embodiments of the disclosure.

FIG. 6 is a view illustrating an emission period when a high current flows through a light emitting element in a display device according to embodiments of the disclosure.

The high period when the magnitude of the current flowing through the light emitting element is relatively large differs from the above-described low period in that the light emitting signal EM is applied as the turn-on level voltage in a state in which the third scan signal Scan3 remains the turn-off level voltage.

In other words, immediately before the light emission signal EM of the turn-on level voltage is applied in the high period, the reset voltage VAR is not applied to the first electrode of the light emitting element.

Since the voltage of the first electrode of the light emitting element is slightly increased in the low period, if the turn-on level voltage is applied to the light emission signal EM, the level of the voltage applied to the first electrode of the light emitting element is further increased than in the low period. Accordingly, a relatively large current flows through the organic light emitting element OLED in the high period, and the light emitting element may emit light more brightly.

The above-described low period and high period may be alternately positioned in one emission period.

The above-described low period and high period may exist twice or more during one emission period. The light emitting element may emit light two or more times during one active period. A magnitude of a current flowing through the light emitting element may be varied during a period when the light emitting element successively emits light two or more times.

Figure 7:
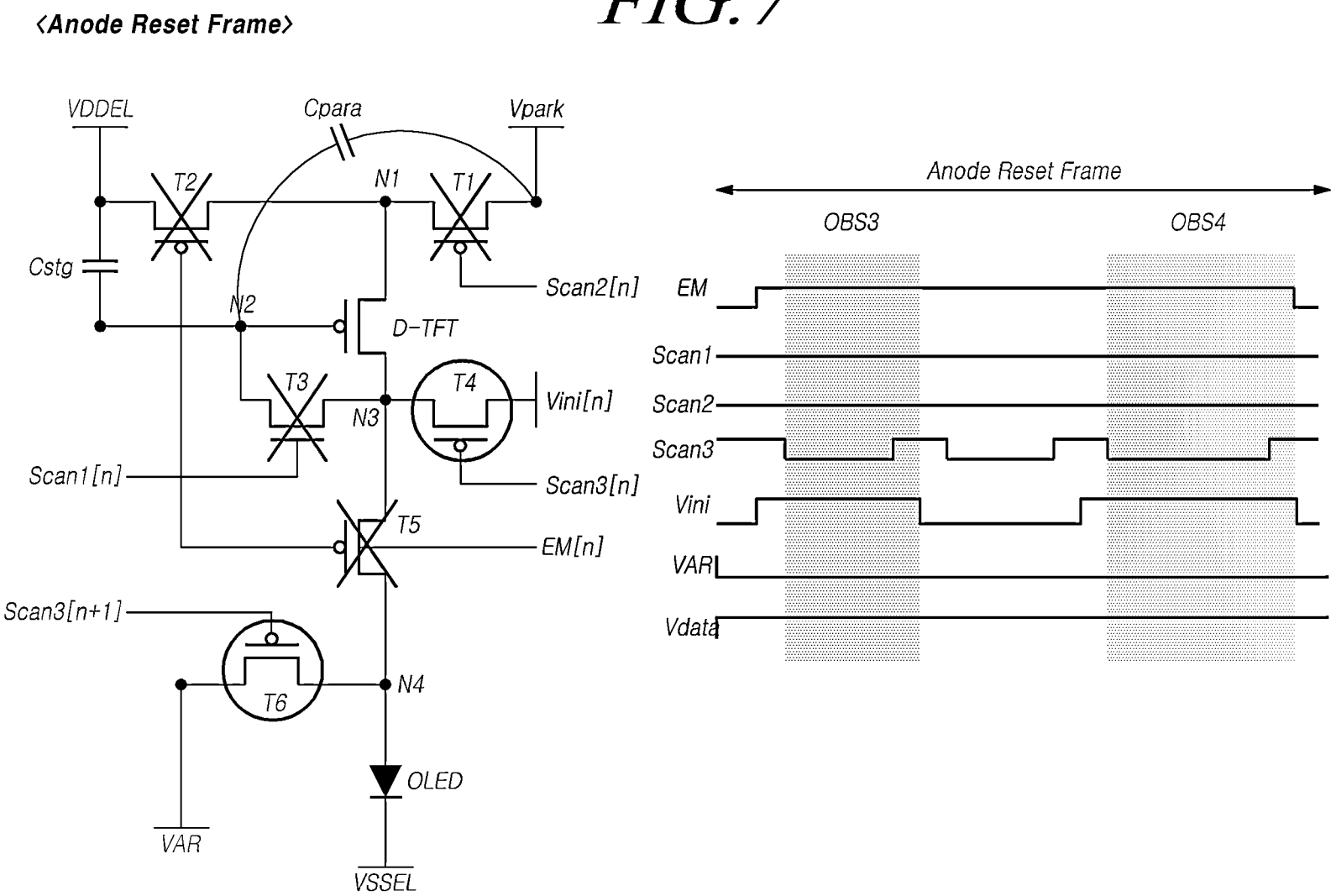
FIG. 7 is a view illustrating an anode reset frame in a display device according to embodiments of the disclosure.

FIG. 7 is a view illustrating an anode reset frame in a display device according to embodiments of the disclosure.

Referring to FIG. 7, the light emission signal EM of a turn-off level voltage is applied to the second transistor T2 and the fifth transistor T5. A first scan signal Scan1 of a turn-off level voltage is applied to the third transistor T3. A second scan signal Scan2 of a turn-off level voltage is applied to the first transistor T1. A third scan signal Scan3 is applied to the fourth transistor T4 and the sixth transistor T6. As the third scan signal Scan3, the turn-on level voltage and the turn-off level voltage may alternate during the anode reset frame period.

When the third scan signal Scan3 is a signal of a turn-on level voltage, the fourth transistor T4 is turned on. An initialization voltage Vini_H of a high level voltage is applied to the third node N3 of the driving transistor D-TFT.

During the anode reset frame period, the initialization voltage Vini_H of the high-level voltage may be applied to the third node N3 of the driving transistor D-TFT, and the corresponding period may be the third on-bias period OBS3 and the fourth on-bias period OBS4.

When the third scan signal Scan3 is a signal of a turn-on level voltage, the sixth transistor T6 is turned on. The anode reset voltage VAR is applied to the first electrode of the organic light emitting element OLED.

The voltage level of the anode reset voltage VAR applied to the first electrode of the organic light emitting element OLED during the anode reset frame period may be different from the voltage level of the anode reset voltage VAR applied to the first electrode of the organic light emitting element OLED during the refresh frame period. When the levels of the voltages applied to the first electrode of the organic light emitting element OLED during the two periods differ from each other, to distinguish the two voltages, the anode reset voltage VAR during the refresh frame period is denoted by the VAR_A voltage, and the anode reset voltage VAR during the anode reset frame period is denoted by the VAR B voltage.

Referring to FIG. 7, a data voltage Vdata having a preset voltage level is applied to the data line Vdata during the anode reset frame period.

A parasitic capacitance Cpara may be formed between the second node N2 of the driving transistor D-TFT and the data line DL applying the data voltage Vdata to the corresponding driving transistor D-TFT. In some cases, a physical capacitor device having one end electrically connected to the corresponding data line DL and the other end electrically connected to the second node N2 of the driving transistor D-TFT may be disposed. Described below is an example in which the parasitic capacitance Cpara is formed between the second node N2 of the driving transistor D-TFT and the data line DL.

As the parasitic capacitance Cpara is formed between the data line DL and the second node N2 of the driving transistor D-TFT during the anode reset frame period, it is possible to prevent a variation in the voltage level of the second node N2 of the driving transistor D-TFT by applying a preset level of voltage to the data line DL.

The data signal applied to the data line DL to prevent a variation in the voltage level of the second node N2 of the driving transistor D-TFT during the anode reset frame period is referred to as a park voltage Vpark. The voltage level of the park voltage Vpark may be the same as or similar to the voltage level of the data signal Vdata for displaying a black grayscale image or a low grayscale image.

As the variation in the voltage of the second node N2 of the driving transistor D-TFT during the anode reset frame period is minimized, the voltage level of the second node N2 of the driving transistor D-TFT may be substantially equal to or similar to the level of the voltage input during the sampling period Sampling of the previous refresh frame.

Like a parasitic capacitance Cpara may be formed between the second node N2 of the driving transistor D-TFT and the data line DL applying the data voltage Vdata to the corresponding driving transistor D-TFT, a parasitic capacitance Cpara' may also be formed between the first electrode of the organic light emitting element and the data line DL applying the data voltage Vdata to the corresponding driving transistor D-TFT.

Figure 8:
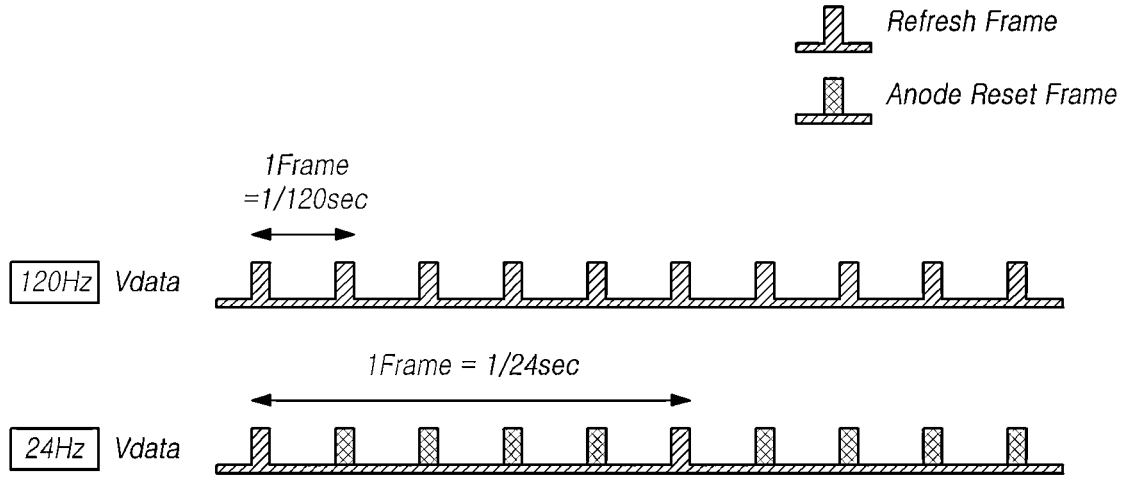
FIG. 8 is a view exemplarily illustrating high-speed driving and low-speed driving in a display device according to embodiments of the disclosure.

FIG. 8 is a view exemplarily illustrating high-speed driving and low-speed driving in a display device 100 according to embodiments of the disclosure.

Referring to FIG. 8, the display device 100 according to embodiments of the disclosure may perform high-speed driving in which all frames are refresh frames. The display device 100 according to embodiments of the disclosure may perform low-speed driving in which at least one anode reset frame exists between different refresh frames.

For example, when the display device according to embodiments of the disclosure is driven at a scan rate of 120 Hz during high-speed driving, all 120 frames displayed for one second are refresh frames.

When the display device is driven at a refresh rate of 24 Hz, 24 frames out of 120 frames displayed for one second are refresh frames, and the remaining 96 frames are anode reset frames. In other words, after one refresh frame, four anode reset frames may follow.

Thus, the display device according to the embodiments of the disclosure may perform both high-speed driving and low-speed driving.

Figure 9:
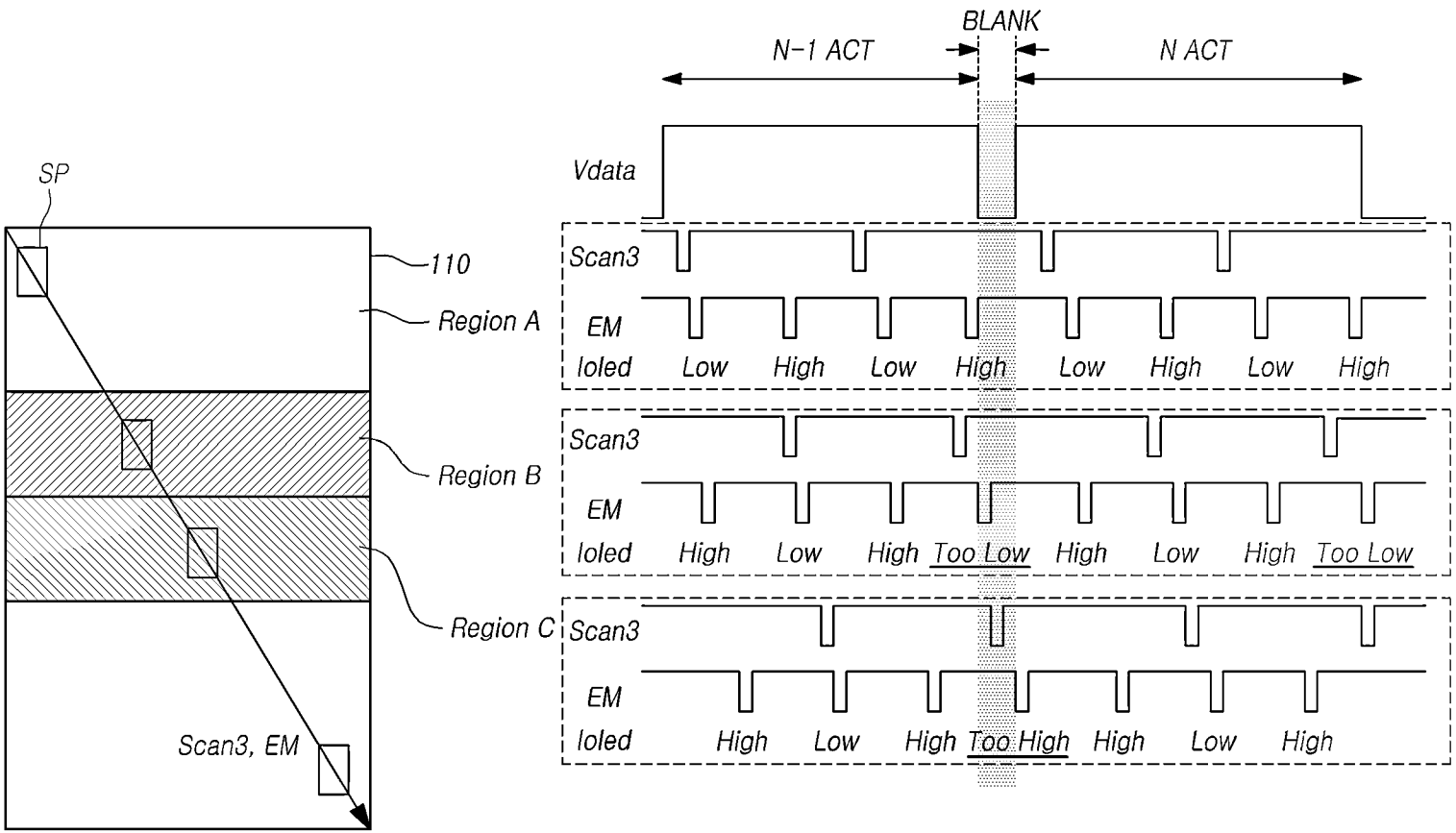
FIG. 9 is a view illustrating an area in which a dark mura occurs and an area in which a bright mura occurs in a display device according to embodiments of the disclosure.

FIG. 9 is a view illustrating a region Region B in which a dark mura occurs and a region Region C in which a bright mura occurs in a display device 100 according to embodiments of the disclosure.

Referring to FIG. 9, a plurality of subpixels SP are positioned on the display panel 110. To cause the plurality of subpixels SP to emit light according to timing, a gate signal (e.g., Scan3, EM, etc.) may be sequentially input to the gate lines GL.

For example, the gate signal is applied in a direction from the top left subpixel SP the display panel 110 to the bottom right subpixel SP of the display panel 110, so that a data voltage Vdata for image display of the next frame is applied to the corresponding subpixels SP.

Accordingly, the timing at which the gate signal is applied varies depending on the position of the subpixel SP in the display panel 110.

Referring to FIG. 9, the display panel 110 includes a first region Region A on the upper side, a second region Region B under the first region Region A, and a third region Region C under the second region Region B.

The timing diagram of FIG. 9 is a timing diagram for the first region Region A, the second region Region B, and the third region Region C. The timing diagram briefly illustrates only the emission period and illustrates only the third scan signal Scan3, the light emission signal EM, and the current Ioled flowing through the light emitting element.

Both the third scan signal Scan 3 of the turn-on level voltage and the light emission signal EM of the turn-on level voltage are applied to the subpixel SP positioned in the first region Region A during the active period. The subpixel SP positioned in the first region Region A emits light during the active period N−1 ACT of the N−1th frame (where N is an integer larger than or equal to 2) and the active period N ACT of the Nth frame.

Referring to FIG. 9, in the subpixel SP positioned in the first region Region A, the number of periods when the current Ioled flowing through the light emitting element during the active period ACT is a low current is equal to the number of periods when the current Ioled flowing through the light emitting element during the active period ACT is a high current.

The subpixel SP positioned in the second region Region B emits light in the active period N−1 ACT of the N−1th frame (where N is an integer larger than or equal to 2), the blank period BLANK, and the active period N ACT of the Nth frame.

During the blank period BLANK, a target voltage of a preset level is applied to the plurality of data lines DL.

The level of the target voltage may be the same as the level of the above-described park voltage Vpark.

The level of the target voltage may be equal or similar to the data voltage for displaying a black grayscale or low grayscale image. Accordingly, during the blank period BLANK, a target voltage of a low voltage level is applied to the plurality of data lines DL.

The subpixel SP positioned in the second region Region B may include a light emitting element, and the above-described parasitic capacitance Cpara' may be formed between the first electrode of the corresponding light emitting element and the data line DL supplying a data voltage to the corresponding subpixel SP.

As a target voltage of a low voltage level is applied to the plurality of data lines DL during the blank period BLANK, the subpixel SP positioned in the second region Region B has a relatively smaller voltage increment of the first electrode of the light emitting element although a light emitting signal EM of a turn-on level voltage is applied.

Accordingly, the voltage difference between the first electrode and the second electrode of the light emitting element during the blank period BLANK becomes smaller, and accordingly, the current Ioled flowing through the light emitting element becomes smaller.

For this reason, dark mura may occur in the second region Region B (corresponding to the section in which Ioled is too low). The second region Region B may be an area in which dark mura is constantly generated.

A subpixel SP to which a light emission signal EM of a turn-on level voltage is applied immediately after the blank period BLANK may be positioned in the third region Region C. A subpixel SP in which a period when a light emission signal EM of a turn-on level voltage is applied overlaps the blank period BLANK and the active period ACT may be positioned in the third region Region C.

The third scan signal Scan3 of the turn-on level voltage is applied to the subpixel SP positioned in the third region Region C during the blank period BLANK, and a reset voltage VAR may be applied to the first electrode of the light emitting element.

According to entry from the blank period BLANK to the active period ACT, the voltage level of the first electrode may be varied in the light emitting element included in the subpixel SP positioned in the third region Region C.

Specifically, as the voltage applied to the plurality of data lines DL abruptly increases from the preset level of the target voltage, the voltage applied to the first electrode of the light emitting element may increase from the reset voltage VAR.

Accordingly, a voltage difference between the voltages applied to the first electrode and the second electrode of the light emitting element increases. If a light emission signal EM of a turn-on level voltage is applied, a high current flows through the light emitting element.

Accordingly, the subpixels SP positioned in the third region Region C have more high current periods than the low current periods during one active period ACT.

A bright mura may be generated in the third region Region C (corresponding to the section in which Ioled is too high). The third region Region C may be an area in which bright mura is constantly generated.

In sum, as the voltage level of the plurality of data lines DL is abruptly varied when entering from the active period ACT to the blank period BLANK or from the blank period BLANK to the active period ACT, mura may occur in the second region Region B and the third region Region C.

Figure 10:
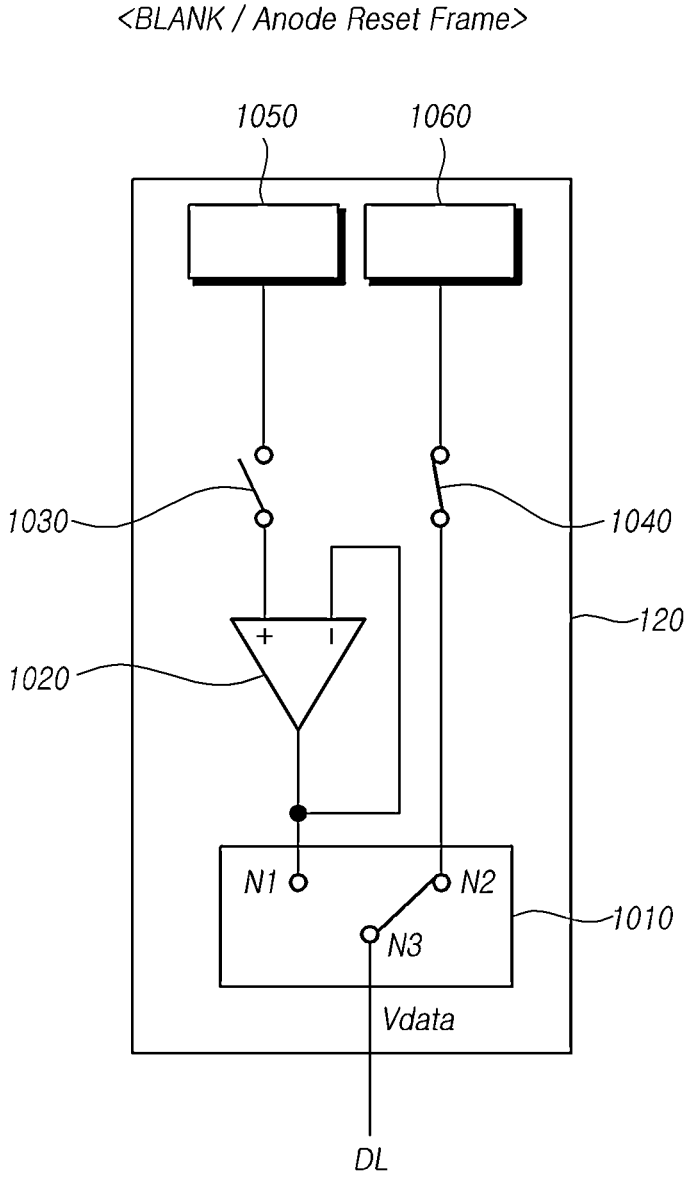
FIG. 10 is a view schematically illustrating a configuration of a data driving circuit according to embodiments of the disclosure.

FIG. 10 is a view schematically illustrating a configuration of a data driving circuit 120 according to embodiments of the disclosure.

Referring to FIG. 10, the data driving circuit 120 according to embodiments of the disclosure may include an image display voltage output circuit 1050, a voltage stabilization circuit 1060, and a multiplexer 1010.

The image display voltage output circuit 1050 is a circuit configured to output the data voltage Vdata for image display.

The image display voltage output circuit 1050 may include a shift register, a data register, a level shifter, and a digital-to-analog converter DAC.

The image display voltage output circuit 1050 may receive various data driving timing control signals including a source start pulse SSP and a source sampling clock SSC and the image data DATA and output the data voltage Vdata for image display.

The voltage stabilization circuit 1060 may be a circuit configured to output a signal of a preset level voltage.

The voltage stabilization circuit 1060 may be a circuit configured to output the data voltage Vdata to the plurality of data lines DL during an anode reset frame period. In the same sense, the voltage stabilization circuit 1060 may be a circuit configured to output the park voltage Vpark to the data line DL.

The voltage stabilization circuit 1060 may be a circuit configured to output the data voltage Vdata of the target voltage level to the plurality of data lines DL during the blank period BLANK.

The voltage value of the target voltage may be the same as the voltage value of the park voltage Vpark. In this case, the voltage stabilization circuit 1060 may output the data voltage Vdata to the data line DL during the blank period BLANK and the anode reset frame period.

The voltage stabilization circuit 1060 may be configured as a separate circuit different from the image display voltage output circuit 1050. Even if the image display voltage output circuit 1050 does not operate, the voltage stabilization circuit 1060 alone may operate to output the data voltage Vdata of a preset level voltage to the plurality of data lines DL.

The multiplexer 1010 may be configured to output any one of the voltage input from the image display voltage output circuit 1050 and the voltage input from the voltage stabilization circuit 1060 to any one data line DL.

The multiplexer 1010 may include a first node N1 electrically connected to the image display voltage output circuit 1050, a second node N2 electrically connected to the voltage stabilization circuit 1060, and a third node N3 electrically connected to one data line DL.

While the first node N1 and the third node N3 of the multiplexer 1010 are electrically connected, the voltage input from the image display voltage output circuit 1050 may be output to the corresponding data line DL.

While the second node N2 and the third node N3 of the multiplexer 1010 are electrically connected, the voltage input from the voltage stabilization circuit 1060 may be output to the corresponding data line DL.

The voltage output from the image display voltage output circuit 1050 may be input to the first node N1 of the multiplexer 1010 through the operational amplifier 1020.

Referring to FIG. 10, the data driving circuit 120 may further include a first switch 1030 configured to switch an electrical connection between the image display voltage output circuit 1050 and the operational amplifier 1020.

The data driving circuit 120 may further include a second switch 1040 configured to switch an electrical connection between the voltage stabilization circuit 1060 and the second node N2 of the multiplexer 1010.

The first switch 1030 may be turned on during a period when the first node N1 and the third node N3 of the multiplexer 1010 are electrically connected.

The second switch 1040 may be turned on during a period when the second node N2 and the third node N3 of the multiplexer 1010 are electrically connected.

In the anode reset frame and the blank period BLANK, the second node N2 and the third node N3 of the multiplexer 1010 may be electrically connected.

Figure 11:
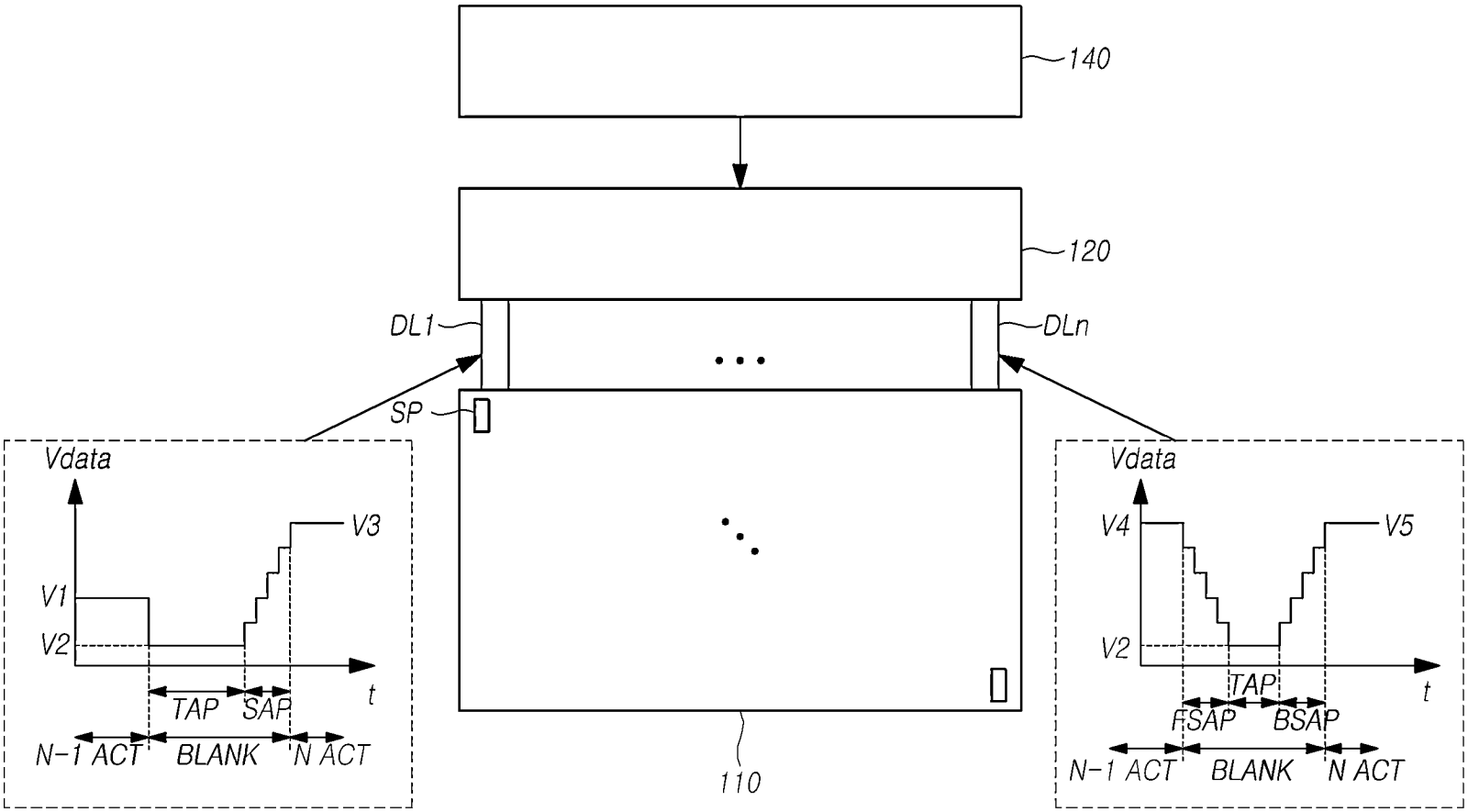
FIG. 11 is a view illustrating an example in which a data driving circuit outputs a step voltage to a data line in a display device according to embodiments of the disclosure.

The blank period BLANK may include a step voltage application period SAP when a step voltage is applied and a target voltage application period TAP (see FIG. 11). The length of the step voltage application period SAP may be shorter than the length of the target voltage application period TAP.

The step voltage application period SAP may include a "front step voltage application period FSAP" when the voltage is stepwise decreased to a target voltage level and outputted.

The step voltage application period SAP may include a "back step voltage application period BSAP" when the voltage is stepwise increased from the target voltage level and outputted.

This step voltage may be input from the image display voltage output circuit 1050 to the data line DL.

If the step voltage level reaches the target voltage level or after a level of the step voltage reaches the target voltage level, the multiplexer 1010 may switch the circuit electrically connected to the data line DL.

The length of the step voltage application period SAP may be 20% or less of the length of the blank period BLANK.

The length of the front step voltage application period FSAP may be within 10% of the length of the blank period BLANK. The length of the back step voltage application period BSAP may be within 10% of the length of the blank period BLANK.

The length of the front step voltage application period FSAP and the length of the back step voltage application period BSAP may be equal to each other but, in some cases, may be different from each other.

During the step voltage application period SAP, the voltage level of the data voltage Vdata may be stepwise increased or decreased.

The length of the "front step voltage application period FSAP" may vary according to the level of the data voltage Vdata applied to the data line DL in the active period ACT immediately before the blank period BLANK.

When the voltage difference between the level of the data voltage Vdata applied to the data line DL in the active period ACT immediately before the blank period BLANK and the level of the target voltage is less than or equal to a preset voltage difference, the voltage of the target voltage level may be immediately applied to the data line DL.

In contrast, the voltage difference between the level of the data voltage Vdata applied to the data line DL in the active period ACT immediately before the blank period BLANK and the level of the target voltage may exceed the preset voltage difference. In this case, a step voltage may be applied to the data line DL. During the step voltage application period, a step voltage of a voltage level higher than target voltage and lower than the data voltage may be applied to the corresponding data line DL.

The length of the "front step voltage application period FSAP" may vary according to the level of the data voltage Vdata applied to the data line DL in the active period ACT immediately before the blank period BLANK.

When the voltage difference between the level of the data voltage Vdata applied to the data line DL in the active period ACT immediately after the blank period BLANK and the level of the target voltage is less than or equal to the preset voltage difference, the data voltage Vdata for image display may be immediately applied to the data line DL.

In contrast, the voltage difference between the data voltage Vdata for image display applied to the data line DL in the active period ACT immediately after the blank period BLANK and the target voltage may exceed the preset voltage difference. In this case, a step voltage may be applied to the data line DL. During the step voltage application period, a step voltage having a voltage level higher than the target voltage and lower than the data voltage for image display may be applied to the corresponding data line DL.

In the step voltage application period SAP, a step voltage having only one voltage level may be applied. In the step voltage application period SAP, a step voltage having two or more levels may be applied.

How many voltage levels the step voltage applied in the front step voltage application period FSAP has may vary depending on the voltage difference between the voltage level of the data voltage Vdata for image display applied to the data line when entering the blank period BLANK and the target voltage level.

How many voltage levels the step voltage applied in the back step voltage application period BSAP has may vary depending on the voltage difference between the voltage level of the data voltage Vdata for image display applied to the data line when entering the active period ACT and the target voltage level.

The length of the step voltage application period SAP may vary depending on how many voltage levels the step voltage applied during the corresponding step voltage application period has. For example, the length of the step voltage application period SAP when a step voltage having two or more voltage levels is applied may be larger than the length of the step voltage application period SAP when a step voltage having one voltage level is applied. A length of a period during which the data driving circuit 120 outputs the step voltage to any one data line among the plurality of data lines may be varied depending on a level of a voltage of the any one data line when entering from the active period to the blank period or a level of a voltage applied to the any one data line when entering from the blank period to the active period.

As the blank period BLANK includes the step voltage application period SAP, the phenomenon in which dark mura is noticed in the above-described second region Region B may be greatly mitigated.

As the blank period BLANK includes the step voltage application period SAP, the phenomenon in which a bright mura is noticed in the above-described third region Region C may be greatly alleviated.

FIG. 11 is a view illustrating an example in which a data driving circuit 120 outputs a step voltage to a data line DL in a display device 100 according to embodiments of the disclosure.

Referring to FIG. 11, the data driving circuit 120 supplies a data voltage Vdata to a plurality of subpixels SP disposed on the display panel 110.

During the blank period BLANK, the data driving circuit 120 may output the data voltage Vdata of the target voltage level to the plurality of data lines DL. During the blank period BLANK, the data driving circuit 120 may output a step voltage to the plurality of data lines DL.

Referring to FIG. 11, the voltage level of the target voltage may be a second voltage V2.

When entering from the active period ACT to the blank period BLANK, a step voltage higher than the level of the target voltage may be applied depending on the level of the data voltage Vdata applied to the data line DL, or the target voltage itself may be applied.

Referring to FIG. 11, when entering from the active period N−1 ACT of the N−1th frame to the blank period BLANK, the data voltage Vdata of the first voltage V1 is applied to the first data line DL1. If the voltage difference between the first voltage V1 and the second voltage V2 is equal to or less than a preset voltage difference, the step voltage may not be applied but the second voltage V2 may be applied.

Upon entering from the active period N−1 ACT of the N−1th frame to the blank period BLANK, the data voltage Vdata of the fourth voltage V4 is applied to the nth data line DLn. If the voltage difference between the fourth voltage V4 and the second voltage V2 exceeds a preset voltage difference, a step voltage higher than the second voltage V2 level may be applied in the "front-step voltage application period FSAP."

When entering from the blank period BLANK to the active period ACT, a step voltage higher than the level of the target voltage may be applied depending on the level of the data voltage Vdata applied to the data line DL, or the target voltage itself may be applied.

Referring to FIG. 11, when entering from the blank period BLANK to the active period ACT, the data voltage Vdata of the third voltage V3 is applied to the first data line DL1. If the voltage difference between the third voltage V3 and the second voltage V2 exceeds a preset voltage difference, a step voltage higher than the second voltage V2 level may be applied in the step voltage application period SAP.

When entering from the blank period BLANK to the active period ACT, the data voltage Vdata of the fifth voltage V5 is applied to the nth data line DLn. If the voltage difference between the fifth voltage V5 and the second voltage V2 exceeds a preset voltage difference, a step voltage higher than the second voltage V2 level is applied in the "back-step voltage application period BSAP."

The blank period BLANK may include a "front-step voltage application period FSAP" and a "back-step voltage application period BSAP". The blank period BLANK may include a target voltage application period TAP. The target voltage application period TAP may exist between the "front-step voltage application period FSAP" and the "back-step voltage application period BSAP."

The controller 140 may control the data driving circuit 120 to control the level of the step voltage. The controller 140 may control the data driving circuit 120 to output a step voltage for a period that does not exceed 20% of the length of the blank period BLANK.

When the data driving circuit 120 includes the above-described multiplexer 1010, the controller 140 may output a data driving timing control signal DCS for controlling the switching timing of the multiplexer 1010. The controller 140 may control the data driving circuit 120 to switch the multiplexer 1010 during the blank period BLANK. For example, the controller 140 may control the multiplexer 1010 to be switched during the target voltage application period TAP.

While the data driving circuit 120 outputs the step voltage, a light emission signal EM of a turn-on level voltage may be applied to any one subpixel SP positioned in the second region Region B. In other words, while the data driving circuit 120 outputs the step voltage, any one subpixel SP positioned in the above-described second region Region B may emit light.

While the data driving circuit 120 outputs the step voltage, a light emission signal EM of a turn-on level voltage may be applied to any one subpixel SP positioned in the third region Region C. In other words, while the data driving circuit 120 outputs the step voltage, any one subpixel SP positioned in the above-described third region Region C may emit light.

Accordingly, it is possible to mitigate degradation of display quality due to the above-described dark mura generation area and bright mura generation area.

The foregoing embodiments of the disclosure are briefly described below.

Embodiments of the disclosure may provide a display device 100 comprising a display panel 110 including a plurality of subpixels SP and a plurality of data lines DL electrically connected with the plurality of subpixels SP, and a data driving circuit 120 outputting a data voltage Vdata to the plurality of data lines DL, wherein the data driving circuit 120 outputs the data voltage Vdata for image display to the plurality of data lines DL during an active period ACT and outputs a step voltage to stepwise decrease a level of the data voltage Vdata to a preset target voltage level or stepwise increase the level of the data voltage Vdata from the target voltage level during a blank period BLANK different from the active period ACT.

Embodiments of the disclosure may provide the display device 100, wherein a period TAP during which the data driving circuit 120 outputs the data voltage Vdata of the target voltage level is longer than a period SAP during which the data driving circuit 120 outputs the step voltage.

Embodiments of the disclosure may provide the display device 100, wherein a length of the period during which the data driving circuit 120 outputs the step voltage is not more than 20% of a length of one blank period BLANK.

Embodiments of the disclosure may provide the display device 100, wherein a period SAP during which the data driving circuit 120 outputs the step voltage during one blank period BLANK is present both before and after a period during which the data voltage Vdata of the target voltage level is output.

Embodiments of the disclosure may provide the display device 100, wherein the target voltage level V2 is a level of the data voltage Vdata for displaying a black grayscale image.

Embodiments of the disclosure may provide the display device 100, wherein a length of a period SAP during which the data driving circuit 120 outputs the step voltage to any one data line DL among the plurality of data lines DL is varied depending on a level of a voltage V1 or V4 of the any one data line DL when entering from the active period ACT to the blank period BLANK or a level of a voltage V3 or V5 applied to the any one data line DL when entering the blank period BLANK to the active period ACT.

Embodiments of the disclosure may provide the display device 100, wherein the data driving circuit 120 includes an image display voltage output circuit 1050 outputting the data voltage Vdata for image display and the step voltage and a voltage stabilization circuit 1060 outputting the data voltage Vdata of the target voltage level.

Embodiments of the disclosure may provide the display device 100, wherein the data driving circuit 120 further includes a multiplexer 1010 configured to output any one of a voltage input from the image display voltage output circuit 1050 and a voltage input from the voltage stabilization circuit 1060 to any one data line DL among the plurality of data lines DL.

Embodiments of the disclosure may provide the display device 100, wherein the multiplexer 1010 is switched during the blank period BLANK.

Embodiments of the disclosure may provide the display device 100, wherein the multiplexer 1010 is switched after a level of the step voltage reaches the target voltage level.

Embodiments of the disclosure may provide the display device 100, wherein the data driving circuit 120 outputs the data voltage Vdata for image display to the plurality of data lines DL during a refresh frame period and outputs the data voltage Vdata of the target voltage level to the plurality of data lines DL during an anode reset frame period between different refresh frames.

Embodiments of the disclosure may provide the display device 100, wherein a level of the step voltage is higher than the target voltage level.

Embodiments of the disclosure may provide the display device 100, wherein each of the plurality of subpixels SP includes a light emitting element, and wherein the light emitting element emits light two or more times during one active period ACT.

Embodiments of the disclosure may provide the display device 100, wherein a magnitude of a current flowing through the light emitting element is varied during a period when the light emitting element successively emits light two or more times.

Embodiments of the disclosure may provide the display device 100, wherein a light emitting element included in at least one subpixel among the plurality of subpixels SP emits light while the data driving circuit 120 outputs the step voltage.

Embodiments of the disclosure may provide a data driving circuit 120 comprising an image display voltage output circuit 1050 outputting a data voltage Vdata for image display during an active period ACT, and a voltage stabilization circuit 1060 outputting the data voltage Vdata of a preset target voltage level, wherein the data driving circuit 120 outputs a step voltage to stepwise decrease a level of the data voltage Vdata to the target voltage level or stepwise increase the level of the data voltage Vdata from the target voltage level during a blank period BLANK other than the active period ACT.

Embodiments of the disclosure may provide the data driving circuit 120, wherein the image display voltage output circuit 1050 outputs the step voltage.

Embodiments of the disclosure may provide the data driving circuit 120, further comprising a multiplexer 1010 configured to output any one voltage of a voltage input from the image display voltage output circuit 1050 and a voltage input from the voltage stabilization circuit 1060 to a data line.

Embodiments of the disclosure may provide the data driving circuit 120, wherein the multiplexer 1010 switches a circuit electrically connected with the data line DL during the blank period BLANK.

Embodiments of the disclosure may provide the data driving circuit 120, wherein a length of a period SAP during which the step voltage is output is varied.

The above-described embodiments are merely examples, and it will be appreciated by one of ordinary skill in the art various changes may be made thereto without departing from the scope of the disclosure. Accordingly, the embodiments set forth herein are provided for illustrative purposes, but not to limit the scope of the disclosure, and should be appreciated that the scope of the disclosure is not limited by the embodiments. The scope of the disclosure should be construed by the following claims, and all technical spirits within equivalents thereof should be interpreted to belong to the scope of the disclosure.

What is claimed is:

1. A display device, comprising:

a display panel including a plurality of subpixels and a plurality of data lines electrically connected with the plurality of subpixels; and a data driving circuit outputting a data voltage to the plurality of data lines, wherein the data driving circuit outputs the data voltage for image display to the plurality of data lines during an active period and outputs a step voltage to stepwise decrease a level of the data voltage to a preset target voltage level or stepwise increase the level of the data voltage from the target voltage level during a blank period different from the active period.

2. The display device of claim 1, wherein the data driving circuit includes:

an image display voltage output circuit outputting the data voltage for image display and the step voltage; and a voltage stabilization circuit outputting the data voltage of the target voltage level.

3. The display device of claim 2, wherein the data driving circuit further includes a multiplexer configured to output any one of a voltage input from the image display voltage output circuit and a voltage input from the voltage stabilization circuit to any one data line among the plurality of data lines.

4. The display device of claim 3, wherein the multiplexer includes a first node electrically connected to the image display voltage output circuit, a second node electrically connected to the voltage stabilization circuit, and a third node electrically connected to one data line, wherein the data driving circuit further includes an operational amplifier, a first switch and a second switch, wherein the first switch is configured to switch an electrical connection between the image display voltage output circuit and the operational amplifier, and wherein the second switch is configured to switch an electrical connection between the voltage stabilization circuit and the second node of the multiplexer.

5. The display device of claim 4, wherein in the blank period, the second node and the third node of the multiplexer are electrically connected.

6. The display device of claim 3, wherein the multiplexer is switched during the blank period.

7. The display device of claim 3, wherein the multiplexer is switched after a level of the step voltage reaches the target voltage level.

8. The display device of claim 1, wherein the data driving circuit outputs the data voltage for image display to the plurality of data lines during a refresh frame period and outputs the data voltage of the target voltage level to the plurality of data lines during an anode reset frame period between different refresh frames.

9. The display device of claim 8, wherein each of the plurality of subpixels includes an organic light emitting element and a driving transistor configured to drive the organic light emitting element, and wherein the refresh frame includes a first on-bias period and a second on-bias period configured to apply an initialization voltage of a high-level voltage to a source or drain node of the driving transistor and a sampling period between the first on-bias period and the second on-bias period and configured to apply a voltage corresponding to the data voltage to a gate node of the driving transistor.

10. The display device of claim 9, wherein a voltage level of a reset voltage applied to a first electrode of the organic light emitting element immediately before a light emission signal of a turn-on level voltage is applied is equal to a voltage level of a low-potential driving voltage applied to a second electrode of the organic light emitting element.

11. The display device of claim 1, wherein a period during which the data driving circuit outputs the data voltage of the target voltage level is longer than a period during which the data driving circuit outputs the step voltage.

12. The display device of claim 11, wherein a length of the period during which the data driving circuit outputs the step voltage is not more than 20% of a length of one blank period.

13. The display device of claim 1, wherein each of the plurality of subpixels includes a light emitting element, and wherein the light emitting element emits light two or more times during one active period.

14. The display device of claim 13, wherein a magnitude of a current flowing through the light emitting element is varied during a period when the light emitting element successively emits light two or more times.

15. The display device of claim 1, wherein a period during which the data driving circuit outputs the step voltage during one blank period is present both before and after a period during which the data voltage of the target voltage level is output.

16. The display device of claim 1, wherein the target voltage level is a level of the data voltage for displaying a black grayscale image.

17. The display device of claim 1, wherein a length of a period during which the data driving circuit outputs the step voltage to any one data line among the plurality of data lines is varied depending on a level of a voltage of the any one data line when entering from the active period to the blank period or a level of a voltage applied to the any one data line when entering from the blank period to the active period.

18. The display device of claim 1, wherein a level of the step voltage is higher than the target voltage level.

19. The display device of claim 1, wherein a light emitting element included in at least one subpixel among the plurality of subpixels emits light while the data driving circuit outputs the step voltage.

20. A data driving circuit, comprising:

an image display voltage output circuit outputting a data voltage for image display during an active period; and a voltage stabilization circuit outputting the data voltage of a preset target voltage level, wherein the data driving circuit outputs a step voltage to stepwise decrease a level of the data voltage to the target voltage level or stepwise increase the level of the data voltage from the target voltage level during a blank period other than the active period.

21. The data driving circuit of claim 20, further comprising a multiplexer configured to output any one voltage of a voltage input from the image display voltage output circuit and a voltage input from the voltage stabilization circuit to a data line.

22. The data driving circuit of claim 21, wherein the multiplexer includes a first node electrically connected to the image display voltage output circuit, a second node electrically connected to the voltage stabilization circuit, and a third node electrically connected to one data line, wherein the data driving circuit further includes an operational amplifier, a first switch and a second switch, wherein the first switch is configured to switch an electrical connection between the image display voltage output circuit and the operational amplifier, and wherein the second switch is configured to switch an electrical connection between the voltage stabilization circuit and the second node of the multiplexer.

23. The data driving circuit of claim 22, wherein in the blank period, the second node and the third node of the multiplexer are electrically connected.

24. The data driving circuit of claim 21, wherein the multiplexer switches a circuit electrically connected with the data line during the blank period.

25. The data driving circuit of claim 20, wherein the image display voltage output circuit outputs the step voltage.

26. The data driving circuit of claim 20, wherein a length of a period during which the step voltage is output is varied.

* * * * *